US011162516B2

(12) United States Patent
Noord

(10) Patent No.: US 11,162,516 B2
(45) Date of Patent: Nov. 2, 2021

(54) RECIPROCATING PISTON MOTOR, MOTOR-PUMP ASSEMBLY AND METHOD FOR DRIVING A PUMP

(71) Applicant: Jan Noord, Ubbena (NL)

(72) Inventor: Jan Noord, Ubbena (NL)

( * ) Notice: Subject to any disclaimer, the term of this patent is extended or adjusted under 35 U.S.C. 154(b) by 47 days.

(21) Appl. No.: 16/507,337

(22) Filed: Jul. 10, 2019

(65) Prior Publication Data

US 2020/0018330 A1 Jan. 16, 2020

(30) Foreign Application Priority Data

Jul. 16, 2018 (NL) ..... 2021314

(51) Int. Cl.
*F15B 13/06* (2006.01)
*F04B 9/129* (2006.01)

(52) U.S. Cl.
CPC ..... *F15B 13/06* (2013.01); *F04B 9/129* (2013.01)

(58) Field of Classification Search
CPC ..... F04B 9/29; F15B 13/06; F15B 11/0365; F15B 11/036; F15B 15/1404
USPC ..... 91/534
See application file for complete search history.

(56) References Cited

U.S. PATENT DOCUMENTS 3,282,167 A 11/1966 Mckenzie
5,415,531 A * 5/1995 Cavanaugh ..... F04B 9/133 277/636
5,584,666 A 12/1996 Kozumplik, Jr. et al.
5,616,005 A 4/1997 Whitehead
6,152,705 A 11/2000 Kennedy et al.
2003/0198560 A1* 10/2003 Able ..... F04B 43/0736 417/393
2007/0253847 A1 11/2007 Stamper
2012/0325081 A1* 12/2012 Vivatson ..... F15B 11/036 92/146
2014/0334947 A1* 11/2014 Hackett ..... F04B 23/02 417/214
2015/0322973 A1* 11/2015 Villar ..... F04B 9/131 91/297

FOREIGN PATENT DOCUMENTS

CA 981107 A 1/1976
CN 107676528 A 2/2018
(Continued)

OTHER PUBLICATIONS

International Search Report and Written Opinion for application NL2021314, dated Mar. 26, 2019, 10 pages.

*Primary Examiner* — Abiy Teka
*Assistant Examiner* — Daniel S Collins
(74) *Attorney, Agent, or Firm* — Kacvinsky Daisak Bluni PLLC

(57) ABSTRACT

A reciprocating piston motor, motor-pump assembly and method for driving a pump. The piston motor includes a pressure medium housing, comprising a first pressure medium chamber having a first pressure medium piston, a second pressure medium chamber having a second pressure medium piston, and a pressure medium control system. The pressure medium control system includes a pressure medium inlet and outlet that are operatively connected to the pressure medium housing. The pressure medium control system is configured to move the pressure medium pistons. A coupling system is provided that is configured to combine the driving forces generated by the first and second pressure medium pistons for driving a fluid pump.

20 Claims, 7 Drawing Sheets

(56) References Cited

FOREIGN PATENT DOCUMENTS

| | | | |
|---|---|---|---|
| FR | 2146020 | A5 | 2/1973 |
| FR | 2735837 | A1 | 12/1996 |
| GB | 1420424 | A | 1/1976 |
| JP | H0837222 | A | 2/1996 |

* cited by examiner

RECIPROCATING PISTON MOTOR, MOTOR-PUMP ASSEMBLY AND METHOD FOR DRIVING A PUMP

CROSS-REFERENCE TO RELATED APPLICATIONS

This application claims priority to pending Netherlands patent application serial number 2021314, filed Jul. 16, 2018, the entirety of which application is incorporated by reference herein.

FIELD OF THE DISCLOSURE

The present invention relates to a reciprocating piston motor that operates under influence of a pressure medium such as compressed air. More specifically the reciprocating piston motor relates to a reciprocating pneumatic motor.

BACKGROUND OF THE DISCLOSURE

Reciprocating pneumatic motors can be used to generate fluid pressure inside tubes, pressure vessels, valves and hoses to check their integrity, relating to leak tightness and strength. Preferably, the applied pressure is higher as compared to the normal operating pressures.

In practice, conventional reciprocating piston motors using a pressure medium such as compressed air often have a limited pressure range of operation. Furthermore, conventional motors are sensitive to malfunctioning. In addition, these conventional motors require a relatively large number of parts, thereby resulting in a complex motor system.

SUMMARY OF THE DISCLOSURE

The objective of the present invention is to provide a reciprocating piston motor that is robust and stable in a broad range of conditions and situations, and is preferably provided with a simple design enabling cost effective manufacturing.

This objective is achieved with the reciprocating piston motor according to the present invention, with the motor comprising:

- a pressure medium housing, comprising:
  - a first pressure medium chamber having a first pressure medium piston;
  - a second pressure medium chamber having a second pressure medium piston;
- a pressure medium control system, comprising:
  - a pressure medium inlet and outlet that are operatively connected to the pressure medium housing, wherein the pressure medium control system is configured to move the pressure medium pistons; and
- wherein a coupling system is provided that is configured to combine the driving forces generated by the first and second pressure medium pistons.

The piston motor according to the invention comprises a pressure medium housing with a first and second pressure medium chamber. Each chamber is provided with a moveable piston. The pressure medium control system uses the pressure medium to control movement of the pistons. To combine the driving forces that are generated by movement of the at least two pistons a coupling system is provided that enables simultaneous movement of the pistons.

In a presently preferred embodiment the pressure medium relates to compressed air and the motor is used to pump fluid such as water with use of a fluid (pump) system.

The multiple piston system of the invention enables design of a reciprocating piston motor that is smaller in size as compared to conventional systems. Preferably, the chambers are provided in a single (pressure medium) housing thereby providing a compact design that is relatively easy to handle. Furthermore, providing a motor with a single housing with multiple chambers provides a motor with a relatively low weight, especially considering the pressure that can be achieved with the motor.

Preferably, the coupling system connects the respective parts of the different chambers. This achieves a joint movement of the pistons with substantially the same pressure build up.

In a presently preferred embodiment the coupling system comprises a by-pass connecting the different chambers. This configuration with a by-pass provides a simple design and obviates the need for complex software control systems, for example. Preferably, the by-pass comprises a first by-pass and a second by-pass connecting respective parts of the pressure medium chambers on respective sides of the pressure medium pistons. More in particular, the by-passes connect co-operating sides of the piston to achieve a double-acting effect op the pistons. This improves the efficiency of the pneumatic piston motor according to the invention.

In a presently preferred embodiment of the invention the pressure medium control system comprises a central control valve configured for steering the piston motor in co-operation with the coupling system.

Providing a central control valve, to which is also referred to as a pilot valve, a relatively simple, robust and stable control of the movement of the pistons is achieved. Preferably, the control valve is positioned between the first and second medium pressure chambers. This provides a design that is even more compact and, there for, easier to handle for a user. In addition, this enables incorporation of the control valve in the pressure medium housing, more particularly in a middle section thereof. This reduces the risk of fouling or disturbances affecting the operation of the control valve. Furthermore, such integrated design of the control valve with the chambers enables cost effective manufacturing of such embodiment of the reciprocating piston motor according to the invention. Furthermore, the central position of the central control valve enables an effective and substantially direct coupling of the respective parts of the different chambers. This reduces the risk of the pistons bouncing in an unstable position and ensures that the pistons move all the way over the entire length of their stroke.

In a further preferred embodiment of the invention the control valve comprises a first and a second end that in use are actuated by one of the pistons in the first and/or second pressure medium chamber.

Actuation of the control valve by the pistons enables a direct actuation of the control valve. This provides a robust and stable control of the reciprocating piston motor that is less sensitive for fouling, for example.

Preferably, the control valve comprises at least one spring element configured for moving and/or maintaining the control valve in the desired position. Optionally, both ends of the control valve are provided with a separate spring element to have the same effect on both sides of the control valve, or more specifically on both sides of the control core. Furthermore, the spring element or elements contribute to keeping the valve core in the desired position.

In a presently preferred embodiment the piston first contacts the spring element and compresses this element, thereby building up pressure to the valve core such that, after movement is initiated, the core moves to the other position in full. This achieves a robust and stable operation of the control valve. In addition, the seal element or elements also contribute to an effective sealing of the respective valve parts.

In a further preferred embodiment of the present invention the control valve is substantially provided in a middle section between a first and second medium chamber.

Providing the control valve in a middle section between the different chambers enables an integrated design such that the control valve, more specifically the valve core, moves in the pressure medium housing with the aforementioned effects and advantages. Furthermore, providing the control valve in the middle section enables an effective control, wherein preferably the two ends are in contact with their respective chambers, optionally with the aid of the spring element or elements.

Preferably, the middle section further comprises a pressure medium supply valve and one or two pressure medium outlet valves for controlling movement of the pressure medium pistons. By incorporating further valves in the middle section an integral design can be further improved. This obviates the need for separate pressure controls and reduces the risk of fouling. The middle section acts as housing for the valves of the pressure medium system. Furthermore, this provides a relatively simple design. This simple design can even be improved by using a so-called "seal in groove" configuration/construction, wherein the pressure medium housing, especially the middle section, is part of the valve. Valve parts only require a groove or channel or slot that is provided with a sealing ring, such as "O"-ring to limit the motion and seal the respective passages. This provides an effective control of the reciprocating piston motor.

Preferably, the aforementioned valves are controlled by the control valve and move between their respective states in a joint and/or coordinated motion. This enables a (partially) combined movement achieving an optimal and effective control, while reducing the risk of malfunctioning.

In a further preferred embodiment of the invention the motor further comprises a locking system for holding one or more of the valves.

Providing a locking system prevents stalling of the reciprocating motion. This is especially effective at relatively low pressures below 4 Bar. Preferably, the locking system comprises one or more rolling elements, such as balls or rolls. This locking system assures that sufficient (pilot/control) pressure is built before valves moves and, in addition, achieves that valves move fully into the desired position or state. In a presently preferred embodiment use is made of sealing rings, or preferably O-rings. These sealing rings load or push the rolling elements inwards to achieve the locks.

In a further preferred embodiment the control valve further comprises a seal assembly with a core ring having a contact surface at an angle in the range of 25-75°, preferably in the range of 35-55°, and most preferably with an angle of about 45°. By providing a core ring with a contact surface that is put at an angle, the effect of friction between moving and stationary parts is reduced. This reduces friction and stake-slip.

In a further preferred embodiment the motor comprises one or more air relieve valves comprising a blocking element and a spring element that is configured for maintaining the blocking element in its seat, wherein the air relieve valve is configured to allow fast reciprocating motion.

In practice, with conventional reciprocating motors, the speed thereof is limited by the amount of air that the exhaust system can handle. Often, in these conventional systems the drive pressure is at least partly consumed for pushing the exhaust air out. This may slow down the reciprocating motion. The air relieve valve according to the embodiment of the invention remains closed at low (pilot) control pressures thereby keeping the reciprocating motion going even at low drive pressures of the pressure medium. In case of excess pressure this excess pressure is relieved by the valves and operated at high reciprocating motion having a high drive pressure. This provides a robust and stable operation of the motor according to the invention.

In a further preferred embodiment the reciprocating piston motor comprises a handlebar. This improves the easy to handle characteristic of the piston motor. Especially the combination of such handlebar with the low weight integrated design provides a user friendly motor.

The invention further relates to a motor-pump assembly, with the assembly comprising:

- a reciprocating piston motor according to an embodiment of the invention; and
- a fluid system, comprising:
  - a fluid chamber having a fluid inlet and a fluid outlet that are operatively connected to the fluid chamber; and
  - a fluid system piston that is moveable in the fluid chamber and is driven by the first and second pressure medium piston.

The motor-pump assembly provides similar effects and advantages as described for the motor. In a presently preferred embodiment the ratio between the drive pressure and the fluid pressure is substantially fixed, preferably at 60. This ratio corresponds to the surface area where the pressure medium acts upon divided by the surface area the fluid pressure works upon. For example, 2 bars of air pressure will provide a hydraulic pressure of 120 bar. It will be understood that other ratios can be designed accordingly taking into account the user's requirements.

The invention further also relates to a method for driving a pump, the method comprising:

- providing a reciprocating piston motor in an embodiment of the invention;
- supplying pressure medium; and
- operating the motor.

Such method provides similar effects and advantages described for the reciprocating piston motor and/or motor-pump assembly.

BRIEF DESCRIPTION OF THE DRAWINGS

Further advantages, features and details of the invention are elucidated on the basis of preferred embodiments thereof, wherein reference is made to the accompanying drawings, in which.

DETAILED DESCRIPTION

Figure 1:
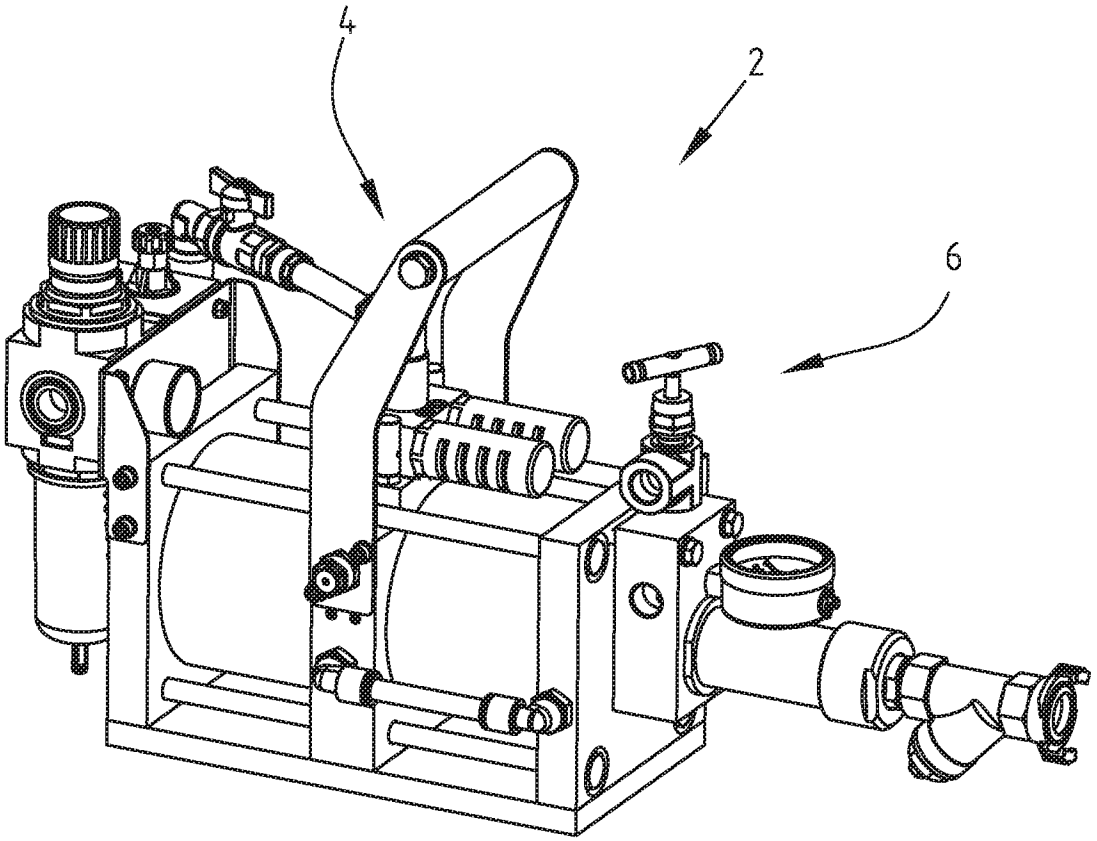
FIG. 1 shows an embodiment of the reciprocating piston motor according to the invention.
Figure 2:
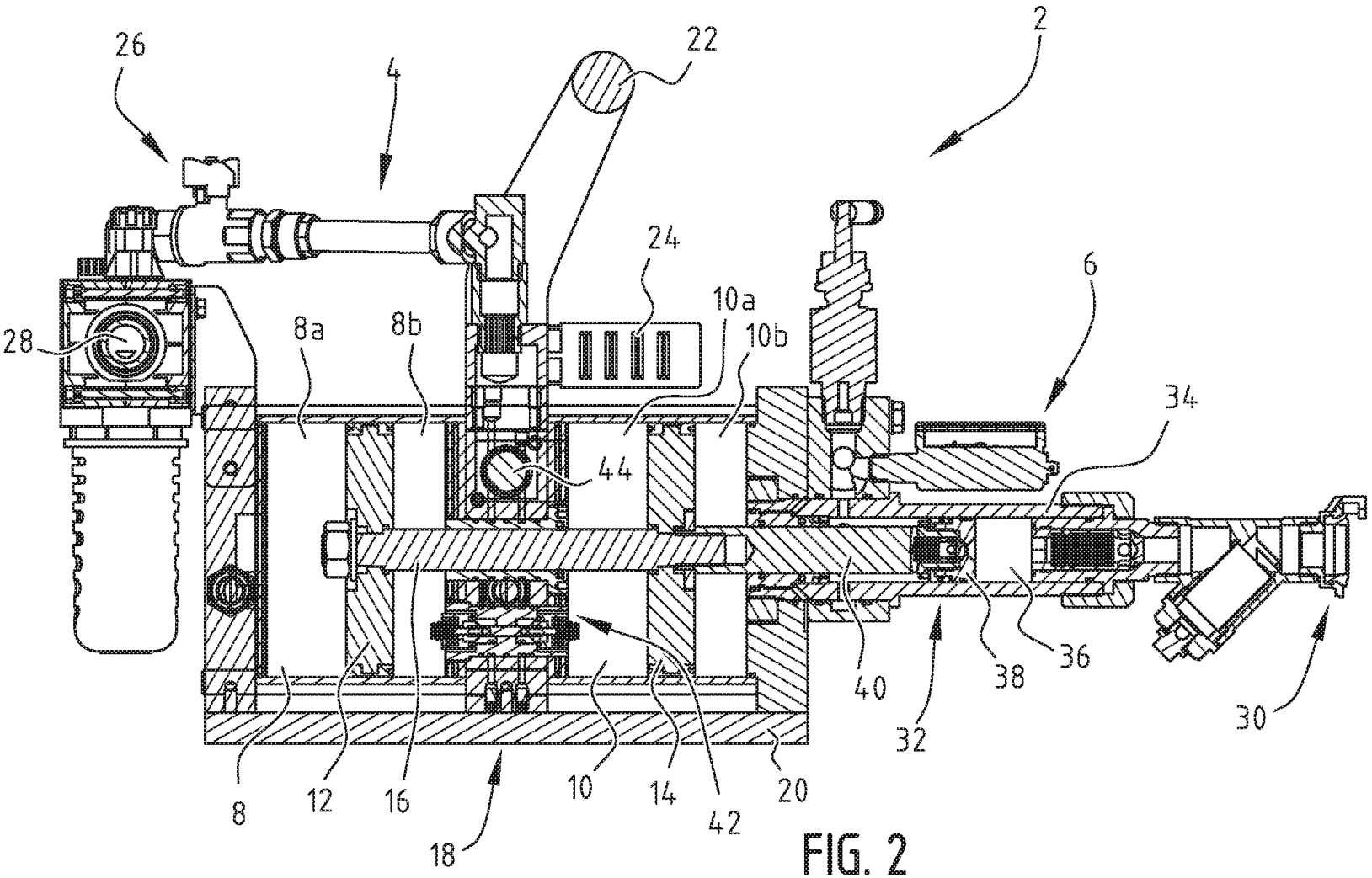
FIG. 2 shows a detailed view of the motor-pump assembly of FIG. 1.

Motor-pump assembly 2 (FIG. 1) comprises reciprocating piston motor 4 and fluid pump system 6. Motor 4 comprises first chamber 8 and second chamber 10 (FIG. 2). In chambers 8, 10 there are provided moveable pistons 12, 14 respectively. Pistons 12, 14 are connected to shaft or rod 16. Chambers 8, 10 comprise different parts 8*a*, 8*b*, 10*a*, 10*b* on respective sides of pistons 12, 14. Chambers 8, 10 are separated by middle section 18 and are provided in pressure medium housing 20. Pressure medium housing 20 is provided with handlebar 22 and is further provided with air exhaust 24, air controls 26 and compressed air inlet 28. Fluid system 6 comprises fluid inlet 30 and high pressure fluid outlet 32. Fluid system 6 further comprises fluid system housing 34 that is provided with fluid chamber 36 and fluid piston 38. In an illustrated embodiment piston 38 is connected via shaft or rod 40 to shaft or rod 16 of motor 4. Middle section 18 of housing 20 comprises control/pilot valve 42 and valve assembly 44.

Figure 3:
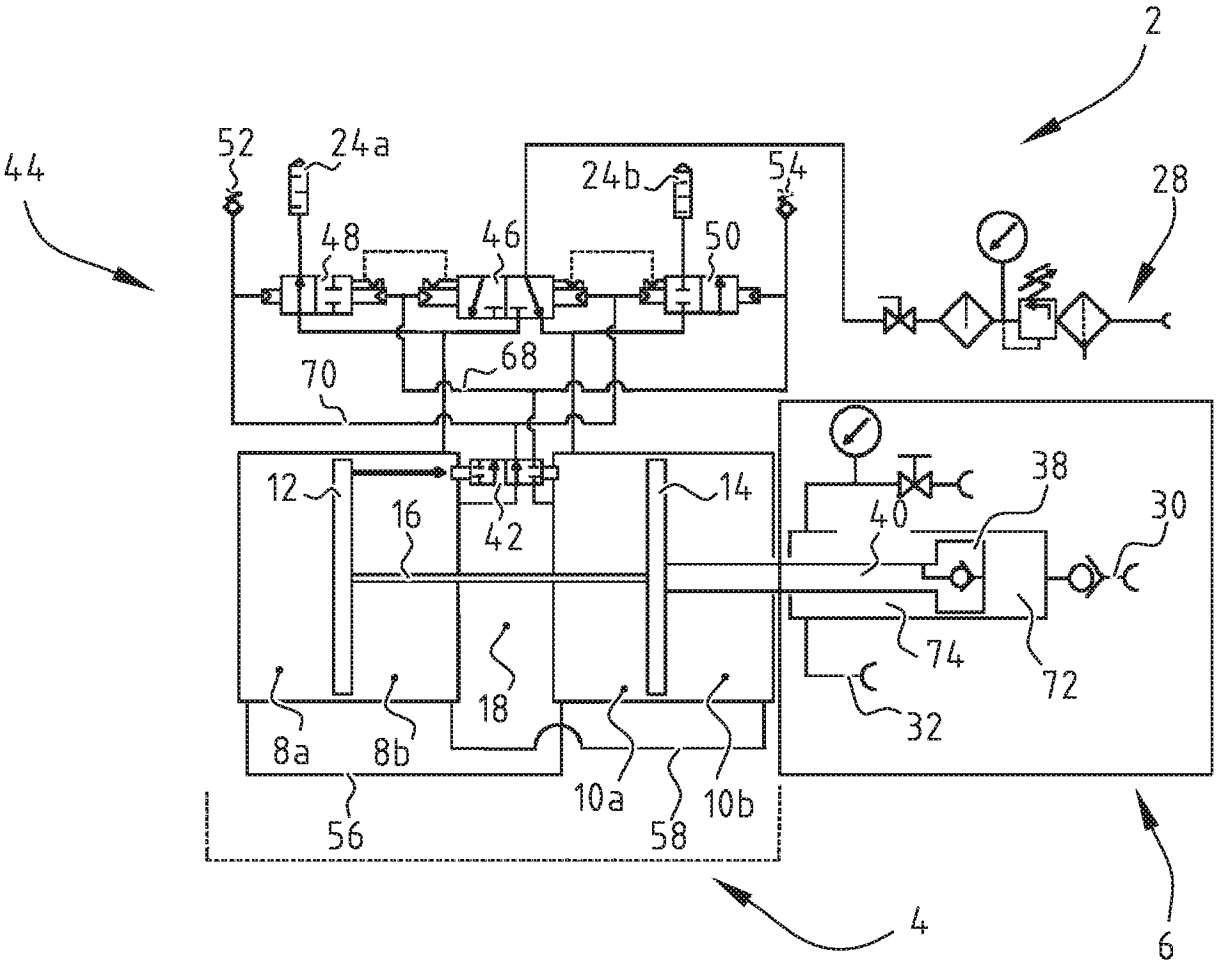
FIG. 3 shows the operational scheme of the assembly of FIGS. 1 and 2.

Valve assembly 44 (FIG. 3) comprises air exhaust valve 46, first air exhaust valve 48 and second air supply valve 50. Furthermore, motor 4 comprises first air relief valve 52 and second air relief valve 54. Furthermore, it will be understood by the skilled person that motor-pump assembly 2 may comprise a number of further pneumatic and/or hydraulic components in alternative configurations of the invention. In addition, the skilled person would understand that some other designs of the configuration could also be envisaged in accordance with the present invention.

Figure 4A:
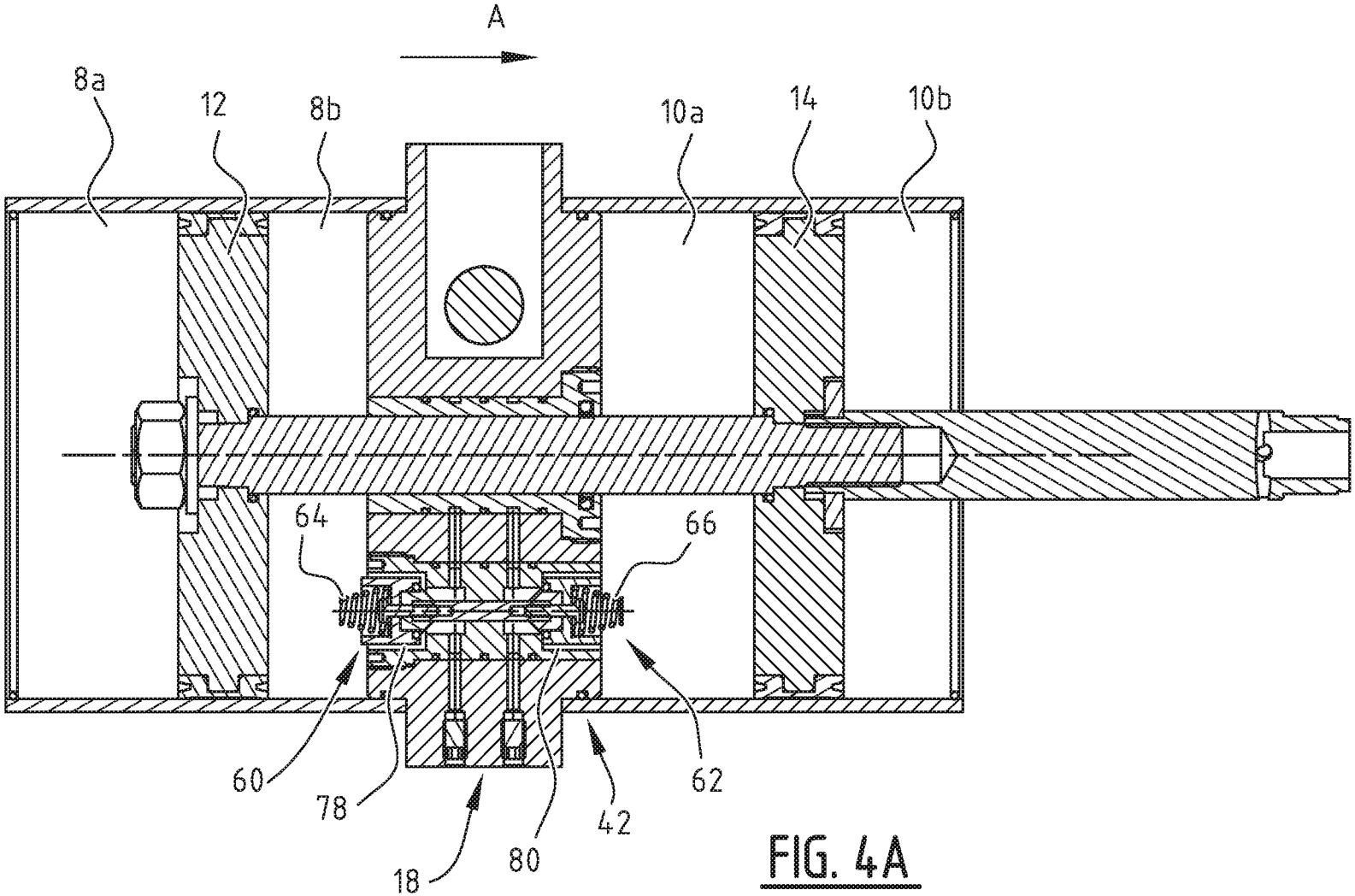
FIGS. 4A and B show the dual piston configuration of the pressure medium housing in the assembly of FIGS. 1-3.

When air pressure is applied to motor 4, and air supply valve 46 is in the illustrated position, air will enter the left parts 8*a*, 10*a* of chambers 8, 10. This is achieved with the use of by-pass 56. In the illustrated embodiment the second exhaust valve 50 is closed. Also control valve 42 is closed as seen from the first parts 8*a*, 10*a*. Therefore, air pressure will be provided to parts 8*a*, 10*a* thereby moving pistons 12, 14 of motor 4 and pushing piston 38 of fluid system 6. No back pressure is built up in parts 8*b*, 10*b* on the opposite side of pistons 12, 14 as air is pushed out with the first air exhaust valve 48 being in the open position. Pistons 12, 14 move in a direction A (FIG. 4A). In the illustrated embodiment chamber parts 8*b*, 10*b* are connected with by-pass 58.

Figure 4B:
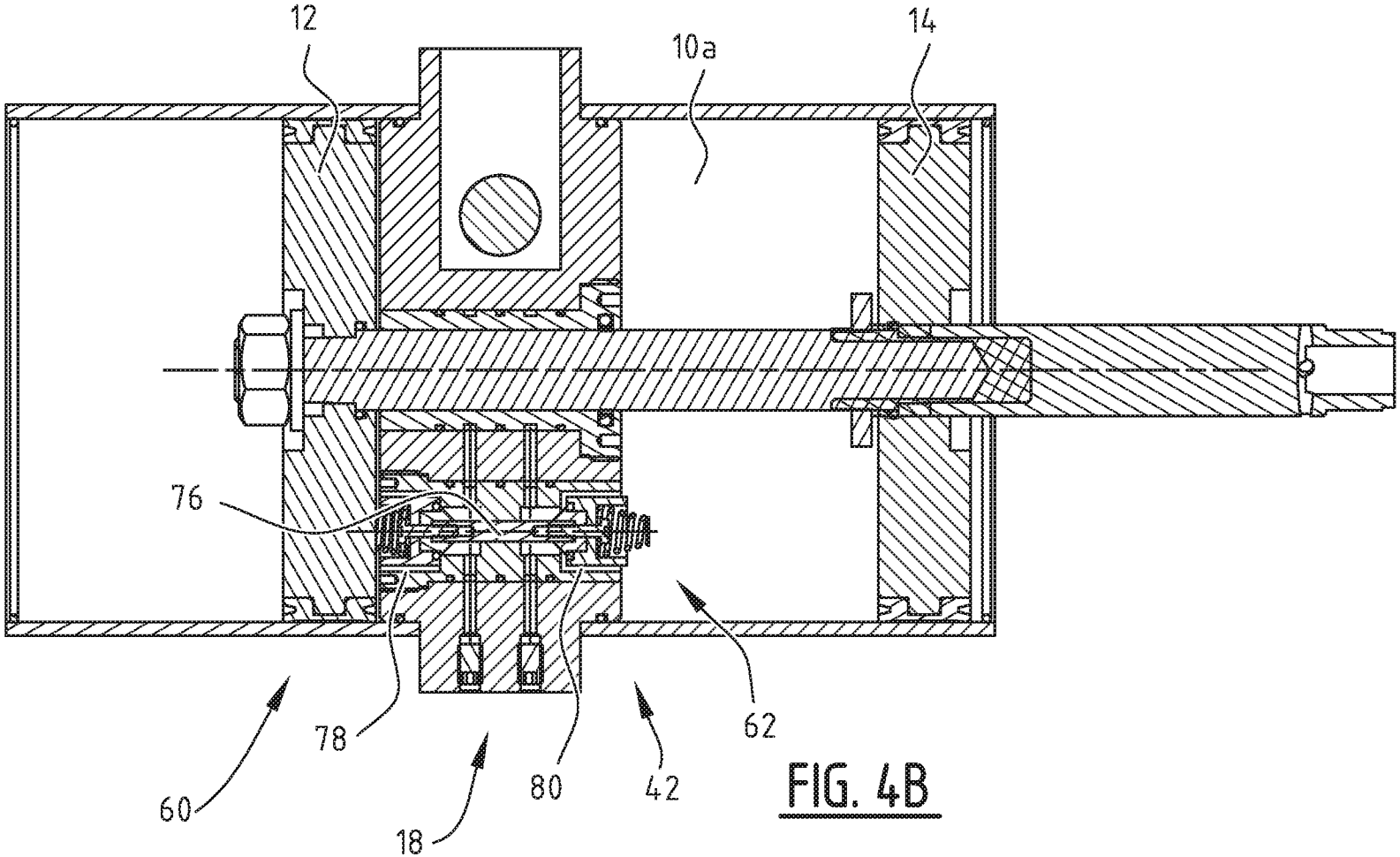

At the end of the stroke the two joined pistons 12, 14 contact control valve 42 (FIG. 4B). At first end 60 and second end 62 of control valve 42 there are respectively provided first spring element 64 and second spring element 66. In the illustrated embodiment piston 12 contacts spring 64 and pushes first end 60 of control valve 42 further into middle section 18. This means that control valve 42 switches its operative position allowing air in part 10*a* to pressurize connection 68. Air supply valve 46 and second air exhaust valve 50 maintain their positions as they are "locked". This lock will be explained later. First air exhaust valve 48 switches its position and closes exhaust passage 24*a*. The lock will break due to the control pressure build up, and air supply valve 46 and second air exhaust valve 50 are forced into their other alternative positions. In the illustrated embodiment this movement engages the "lock" between first air exhaust valve 48*a* and air supply valve 46. Then parts 8*b*, 10*b* are pressurized and parts 8*a*, 10*a* are connected to exhaust 24*a* such that pistons 12, 14 are moved in the opposite direction. At the end of the stroke, piston 14 will actuate control valve 42, more specifically end 62 and spring 66 thereof, such that connection 70 is actuated. Then second air exhaust valve 50 will switch and close exhaust 24*b*. Air pressure in connection 68 will build up and break the lock (as mentioned earlier) to simultaneously switch first air exhaust valve 48 and air supply valve 46. The lock between air supply valve 46 and second air exhaust 50 is set. Then the next cycle may start.

In the illustrated embodiment when actuated control valve 42 closes passage of control air to chambers 8, 10 that was previously in contact with exhaust 24. The three main valves, i.e. first air exhaust valve 48, second air exhaust valve 50 and air supply valve 46 are pneumatically controlled on both sides. When pressurized on one side the air from the actuator on the other side needs to be able to escape. The compressed air on one side of the pistons 12, 14 is used to push out the air, through exhaust 24. On the other side back pressure may build up in the other parts. When actuating control valve 42 this back pressure will at first remain in connections 68, 70 that are linked to exhaust 24 and is now closed. The drive pressure is then applied to control valves 46, 48, 50. However, the valves are initially kept in their position due to the back pressure. Air exhaust valves 48, 50 are capable to bleed and prevent the building of this back pressure to assure that valves 46, 48, 50 will switch their position.

Piston 38 in pump system 6 follows movement of pistons 12, 14 in motor 4. When pistons 12, 14 are pushed to the right hand side of the illustrated embodiment (direction A) fluid head 72 (FIG. 3) is pumped empty and its volume is pushed beyond piston 38 to chamber part 74. When pistons 12, 14 start moving in the opposite direction, fluid in chamber part 74 is pumped out through outlet 32 and new fluid enters fluid head 72 through inlet 30.

Control valve 42 has two ends 60, 62 (FIGS. 4A, B) with valve core 76 extending between two ends 60, 62. In the illustrated embodiment (FIG. 4A) passage 78 is open and passage 80 is closed. Therefore, the pressure is acting on core 76 keeping it in its position. When piston 12 contacts control valve 42 (FIG. 4B) first spring element 64 is loaded and piston 12 continues to move towards middle section 18, while pushing valve core 76 forward. This opens passage 80 and closes passage 78. The pressure present in chamber part 10*a* is allowed into control system, more specifically in connection 68.

Figure 5:
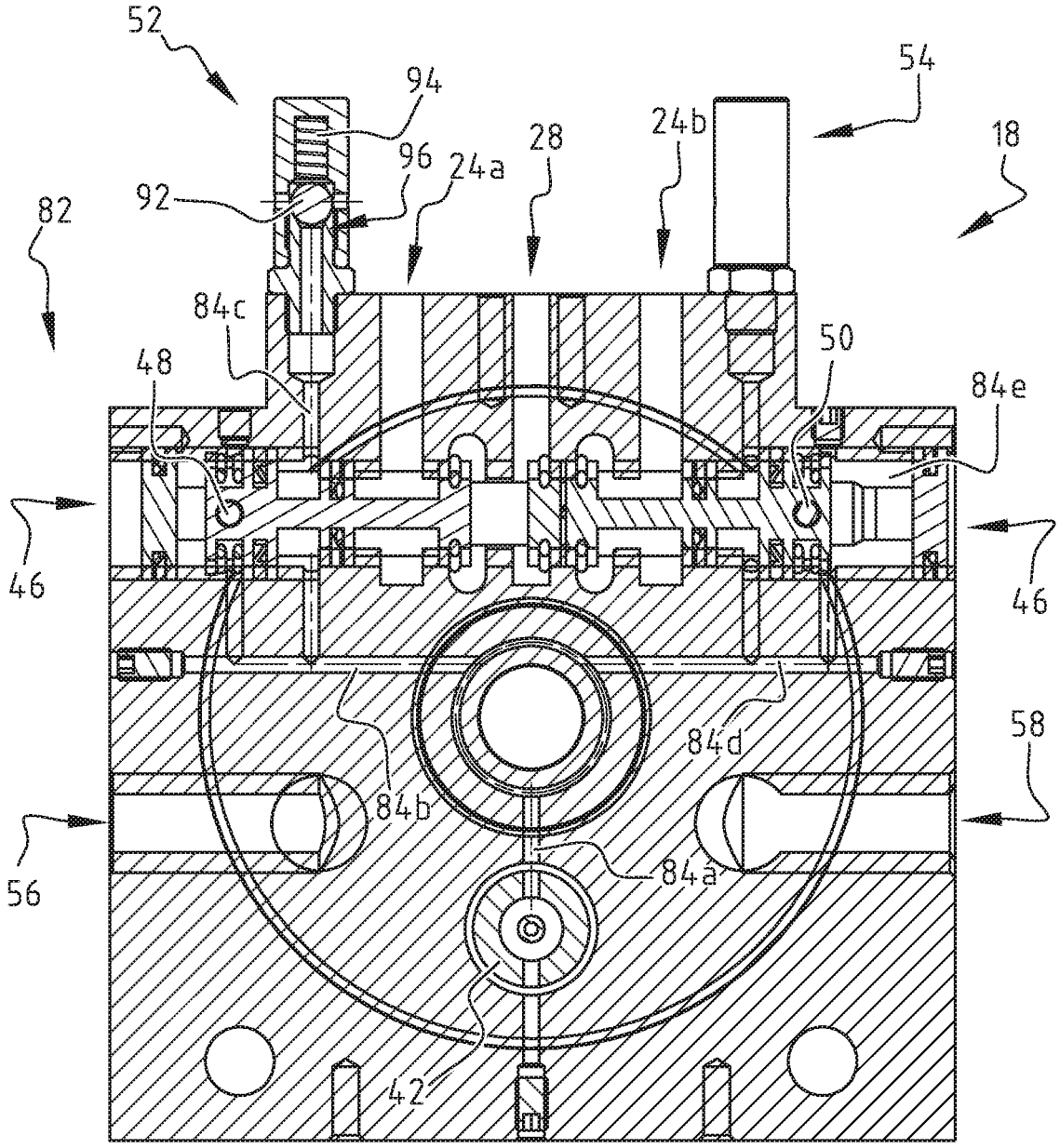
FIG. 5 shows the pressure medium control system in the middle section of the motor of FIGS. 1-4.

In the illustrated embodiment valves 46, 48, 50 are provided in valve assembly 82 (FIG. 5, 6). In this illustrated embodiment valve assembly 82 (FIG. 5) is shown in a post-switch position. Control air travels to passage 84*a*, 84*b*, 84*c*, 84*d* and 84*e*. In this situation first air exhaust valve 48 is pushed outward into the position where valve 48 blocks passage between a pressure chamber part and exhaust 24*a*. In the illustrated embodiment a minimum pressure of 1 bar is required to unlock locked second air exhaust valve 50 with air supply valve 46. When the threshold pressure is reached both second air exhaust valve 50 and air supply valve 46 will switch position simultaneously. In the illustrated embodiment air supply valve 46 will move to the right diverting the air supply from the one chamber part to the other while second air exhaust valve 50 opens the passage between the respective chamber part and exhaust 24*b*. Due to the fact that first air exhaust valve 48 has moved to the left, and in the second stage air supply valve 46 has moved to the right, the lock between the first air exhaust valve 48 and air supply valve 46 engages, thereby locking them together for the next switching sequence when the pistons 12, 14 complete the full stroke in the other direction.

Figure 6:
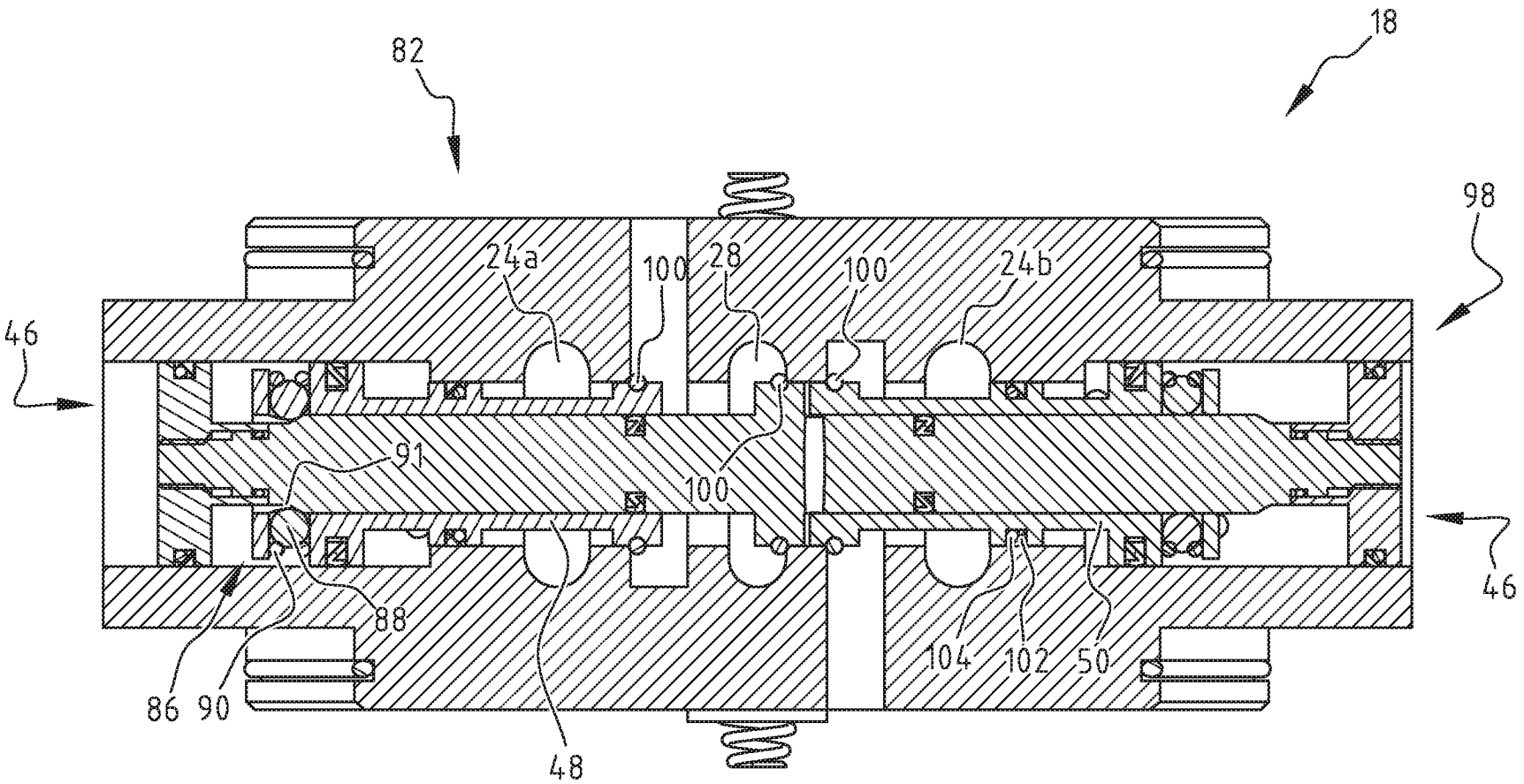
FIG. 6 shows a detail of FIG. 5.

Lock 86 (FIG. 6) comprises balls (or other suitable elements) 88 that are loaded by rings 90. The control pressure is supplied by the drive pressure from the respective chambers. Lock 86 uses conical surface 91 that cooperates with ball 88.

In some situations, the air drive systems is slowed down by the counterforce from the fluid section. When the air drive is used to displace fluid the speed of the reciprocating motion is limited by the speed at which air is pushed out of the chamber part that is connected to exhaust 24. This may create a back pressure in the exhaust 24 and control system. This may result in a malfunction or disturbance. Therefore, air relieve valves 52, 54 are provided that are designed to keep the exhaust back pressure from a fast reciprocating motion below the threshold when a main valve assembly 82 malfunctions. This involves blocking element 92 by spring element 96 that pushes element 92 in its seat 96 (FIG. 5). It will be understood that this configuration can be designed in accordance with the required user specifications.

Valve assembly 82 moves in opening 98 in middle section 18. A number of O-rings 100 limit valve motion at seal passages. This achieves a so-called seal-in-groove functionality.

To reduce friction seal core 102 is provided with a contact surface that is put at an angle relative to the direction of movement of valve assembly 82. O-ring 104 cooperates with seal core 102. In the illustrated embodiment seal core 102 is a PTFE-ring, although other materials can also be envisaged in accordance with the present invention.

The present invention is by no means limited to the above described and preferred embodiments thereof. The rights sought are defined in the following claims, within the scope of which many modifications can be envisaged.

The invention claimed is:

1. A reciprocating piston motor, comprising:

a pressure medium housing, comprising:

a first pressure medium chamber having a first pressure medium piston; and a second pressure medium chamber having a second pressure medium piston; and a pressure medium control system, comprising:

a pressure medium inlet and outlet that are operatively connected to the pressure medium housing, wherein the pressure medium control system is configured to move the pressure medium pistons;

wherein a coupling system is provided that is configured to combine driving forces generated by the first and second pressure medium pistons for driving a fluid pump, the coupling system comprises a by-pass connecting the first and second pressure medium chambers; and wherein the by-pass comprises a first by-pass and a second by-pass connecting respective parts of the pressure medium chambers on respective sides of the pressure medium pistons.

2. The reciprocating piston motor according to claim 1, wherein the pressure medium control system comprises a central control valve configured for steering the piston motor in co-operation with the coupling system.

3. The reciprocating piston motor according to claim 2, wherein the central control valve is positioned between the first and second pressure medium chambers.

4. The reciprocating piston motor according to claim 3, wherein the central control valve comprises a first end and a second end that in use are actuated by one of the pistons in the first and/or second pressure medium chamber.

5. The reciprocating piston motor according to claim 2, wherein the central control valve comprises at least one spring element configured for moving and/or maintaining the central control valve in a desired position.

6. The reciprocating piston motor according to claim 2, wherein the central control valve is substantially provided in a middle section between the first and second pressure chambers.

7. The reciprocating piston motor according to claim 6, wherein the middle section further comprises a pressure medium supply valve and at least one pressure medium outlet valve for controlling movement of the pressure medium pistons.

8. The reciprocating piston motor according to claim 7, wherein the pressure medium supply valve and the at least one pressure medium outlet valve are controlled by the control valve and move between their respective states in a joint motion.

9. The reciprocating piston motor according to claim 7, further comprising a locking system for holding one or more of the valves.

10. The reciprocating piston motor according to claim 9, wherein the locking system comprises one or more rolling elements.

11. The reciprocating piston motor according to claim 2, wherein the control valve further comprises a seal assembly with a core ring having a contact surface at an angle in the range of 25-75°.

12. The reciprocating piston motor according to claim 1, further comprising one or more air relieve valves comprising a blocking element and a spring element that is configured for maintaining the blocking element in its seat, wherein the air relieve valve is configured to allow fast reciprocating motion.

13. The reciprocating piston motor according to claim 1, further comprising a handle bar.

14. A motor-pump assembly, comprising:

a reciprocating piston motor according to claim 1; and a fluid system, comprising:

a fluid chamber having a fluid inlet and a fluid outlet that are operatively connected to the fluid chamber; and a fluid system piston that is moveable in the fluid chamber and is driven by the first and second pressure medium piston.

15. A method for driving a pump, comprising:

providing a reciprocating piston motor according to claim 1;

supplying pressure medium; and operating the motor.

16. The reciprocating piston motor according to claim 8, further comprising a locking system for holding one or more of the valves, wherein the locking system comprises one or more rolling elements.

17. The motor-pump assembly according to claim 14, wherein the pressure medium control system comprises a central control valve configured for steering the piston motor in co-operation with the coupling system, wherein the control valve is provided in a middle section between the first and second pressure medium chambers, wherein the middle section further comprises a pressure medium supply valve and at least one pressure medium outlet valve for controlling movement of the pressure medium pistons, further comprising a locking system for holding one or more of the valves, wherein the locking system comprises one or more rolling elements.

18. The method according to claim 15, wherein the pressure medium control system comprises a central control valve configured for steering the piston motor in co-operation with the coupling system, wherein the control valve is provided in a middle section between the first and second pressure medium chambers, wherein the middle section further comprises a pressure medium supply valve and at least one pressure medium outlet valves for controlling movement of the pressure medium pistons, further comprising a locking system for holding one or more of the valves, wherein the locking system comprises one or more rolling elements.

19. A reciprocating piston motor, comprising:

a pressure medium housing, comprising:

a first pressure medium chamber having a first pressure medium piston; and a second pressure medium chamber having a second pressure medium piston; and a pressure medium control system, comprising:

a pressure medium inlet and outlet that are operatively connected to the pressure medium housing, wherein the pressure medium control system is configured to move the pressure medium pistons;

wherein a coupling system is provided that is configured to combine driving forces generated by the first and second pressure medium pistons for driving a fluid pump, the coupling system comprises a by-pass connecting the first and second pressure medium chambers, and wherein the pressure medium housing further comprises a handlebar.

20. A reciprocating piston motor, comprising:

a pressure medium housing, comprising:

a first pressure medium chamber having a first pressure medium piston; and a second pressure medium chamber having a second pressure medium piston; and a pressure medium control system, comprising:

a pressure medium inlet and outlet that are operatively connected to the pressure medium housing, wherein the pressure medium control system is configured to move the pressure medium pistons;

wherein a coupling system is provided that is configured to combine driving forces generated by the first and second pressure medium pistons for driving a fluid pump, the coupling system comprises a by-pass connecting the first and second pressure medium chambers;

wherein the pressure medium control system comprises a central control valve configured for steering the piston motor in co-operation with the coupling system; and wherein the central control valve comprises at least one spring element configured for moving and/or maintaining the central control valve in a desired position.

* * * * *